US006764371B2

(12) United States Patent
Hartman et al.

(10) Patent No.: US 6,764,371 B2
(45) Date of Patent: Jul. 20, 2004

(54) AERODYNAMIC SOUND-EMITTING AMUSEMENT DEVICE

(76) Inventors: William V. Hartman, 7765 Courtyard Way, Unit 201, Naples, FL (US) 34112; Ralph P. Shaw, Jr., 3520 31st. Ave., SW., Naples, FL (US) 34117

( * ) Notice: Subject to any disclaimer, the term of this patent is extended or adjusted under 35 U.S.C. 154(b) by 0 days.

(21) Appl. No.: 10/357,083

(22) Filed: Feb. 3, 2003

(65) Prior Publication Data

US 2003/0153234 A1 Aug. 14, 2003

Related U.S. Application Data

(60) Provisional application No. 60/355,115, filed on Feb. 8, 2002.

(51) Int. Cl.[7] ..... A63H 27/00

(52) U.S. Cl. ..... 446/46; 446/47; 473/588

(58) Field of Search ..... 446/46, 47, 48, 446/213, 216, 242, 258, 251, 252, 265, 397; 473/588, 589; 273/147

(56) References Cited

U.S. PATENT DOCUMENTS

| | | | | |
|---|---|---|---|---|
| 3,359,678 A | | 12/1967 | Headrick | |
| 3,900,986 A | | 8/1975 | Torres | |
| 3,900,987 A | * | 8/1975 | Holt | 46/74 D |
| 4,031,655 A | | 6/1977 | Ponciano et al. | |
| 4,058,314 A | * | 11/1977 | Wolf | 273/106 B |
| 4,297,809 A | | 11/1981 | Branson | |
| 5,083,799 A | * | 1/1992 | Thill | 273/424 |

* cited by examiner

*Primary Examiner*—Derris H. Banks
*Assistant Examiner*—Jamila Williams
(74) *Attorney, Agent, or Firm*—Allen D. Brufsky

(57) ABSTRACT

An amusement device toy in the shape of a flying saucer disk having aero-dynamically shaped whistle structures for emitting different tones when the disk is thrown into the air, mounted symmetrically on the periphery of the disk. The size of the whistle air chambers may be varied or the openings for admitting air displaced at different angles to obtain the different tones, while the aero-dynamic shape of the whistle assures laminar flow of air over the whistle entry for increased air flow.

15 Claims, 5 Drawing Sheets

AERODYNAMIC SOUND-EMITTING AMUSEMENT DEVICE

CROSS-REFERENCES TO RELATED APPLICATION

This application claims the priority date of U.S. Provisional Application Serial No. 60/355,115, filed Feb. 8, 2002.

BACKGROUND OF THE INVENTION

1. Field of the Invention

This invention relates to amusement devices adapted to sail through the air and more particularly to such devices having a sound-emitting structure.

2. Description of the Prior Art

Present-day amusement devices which sail through the air, after being thrown, are generally circular and designed with aerodynamic principles in mind so that they sail with a spinning motion. One such device is illustrated in U.S. Pat. No. 3,359,678. When properly thrown, such devices remain airborne due to lifting forces exerted by the relative movement of the air caused, in part, by the spinning action. These devices eventually settle to the ground, after being thrown, as the spinning action continues, providing amusement and delight to users.

Such amusement devices, as described, are for the most part, noise-free as they sail through the air because of the desire to keep the structure aerodynamically clean. However, if sound were to be emitted from such a device as it sails through the air and spins, it would add to the enjoyment of the user of the device. Recognizing this, there have been some attempts to provide such a circular, amusement device with sound-emitting structure. Known devices with sound-emitting structure are described in U.S. Pat. Nos. 4,031,655 and 4,297,809.

For the most part, however, many aerodynamic devices of the type to which this invention relates are manufactured and used without sound-emitting structure of any kind because of certain undesirable characteristics. For example, some sound-emitting structures such as whistles are of such complex design that their cost of manufacture would seriously hamper the commercial aspects of marketing the device. Further, other whistle structures proposed are heavy and bulky, thereby affecting and impairing the aerodynamic capabilities of the spinning amusement device. Finally, some known whistle structures for aerodynamic devices will operate only if the device is made to spin in one predetermined direction.

SUMMARY OF THE INVENTION

In order to overcome these deficiencies and increase the enjoyment obtained through the use of such aerodynamic devices, there is provided according to the present invention, a whistle structure mounted upon a circular, thrown and spun amusement device to cause a sound to be emitted from the device as it sails through the air. The sound is generated as a function of the spinning action and horizontal travel of the device.

The device is a shallow saucer-shaped body having a central axis about which is a circular portion and an outer rim that circumscribes the circular portion. Symmetrically disposed upon the body, about the central axis of the device is a whistle structure comprising a number of individual whistles that possess a simple, clean, aerodynamic shape and are lightweight to maintain the aerodynamic capabilities of the device.

Each individual whistle has a bottom, side walls, and an apertured top portion which define an enclosure that functions basically as a resonant chamber of fixed size. Throwing the device with a motion to cause it to spin about its central axis, as it sails through the air, will generate an airstream about the device. The apertured top portions of each whistle are positioned so that the airstream blows across the aperture in the top portion, partially into the whistle's chamber and partially away from it. The air entering the chamber causes a vibratory motion, which, in turn, produces a sound, the pitch of which is dependent upon the volume of the chamber and orientation of the aperture relative to the direction of spin imparted to the device. Thus, the whistle functions much as a simple tubular resonator with one end closed, the other end, through the aperture, being open to the atmosphere thereby producing a whistling sound.

The aperture of each whistle is positioned facing perpendicular to a tangent line on the circular central disk so as to be responsive to an airstream generated by the spinning action, as well as horizontal travel of the device. The body of the device can be of thin wall construction with an interior depth sufficient to sustain the lift of the device as it sails through the air. The device can be of one-piece or of a multiple piece construction and can be formed from a moldable, metallic, or other suitable material.

BRIEF DESCRIPTION OF THE DRAWINGS

Further objects and advantages of the invention will become apparent from the following description and claims and from the accompanying drawings, wherein:

DETAILED DESCRIPTION OF THE PREFERRED EMBODIMENTS

Figure 1:
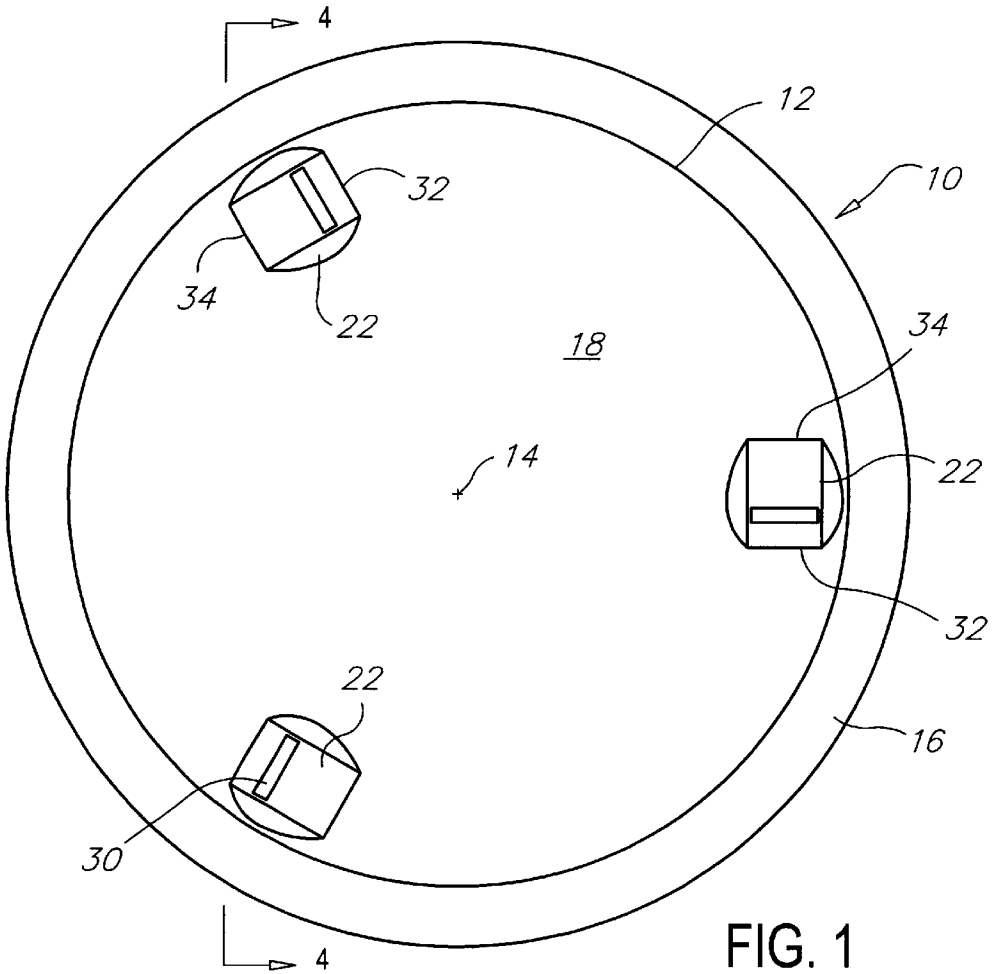
FIG. 1 is a top plan view of the amusement device of the present invention.

Referring now in detail to the drawings, and particularly FIGS. 1 to 5, the aerodynamic amusement device of this invention is broadly designated by the numeral 10 and includes a circular central portion symmetrically situated about central axis 14 and, circumscribing the central portion, a rim 16 which extends downward therefrom. The central portion has a slightly convex top surface 18 with a correspondingly concave bottom surface 20. The rim 16 which curves downward away from the central portion in conjunction with the concave-convex shape of the central portion, forms a generally circular, saucer-like shape. This saucer-like shape provides the central portion with sufficient lift, when spinning through the air in accordance with known aerodynamic principles so that it will remain in the air for a certain distance after being thrown, depending upon the initial velocity imparted to it and its initial height above ground.

The central portion and rim 16 are preferably integral so that device is of one-piece construction. It can be formed of plastic, metal, or other material permitting it to be sailed through the air.

Included in device 10 are Aeolian whistle or sound-emitting structures 22 symmetrically positioned about the circumference of the central portion adjacent rim 16 arranged to maintain the aerodynamic balance of the device. It can be seen, for example, in FIGS. 4 and 5 that whistles 22 extend through the central portion with each whistle 22 including a tubular wall portion 24, a hemispherical bottom portion 26 and a top portion 28 defining an enclosed chamber 29. A generally rectangular aperture 30, located in top portion 24 communicates with the chamber 29 of the whistle.

Figure 9:
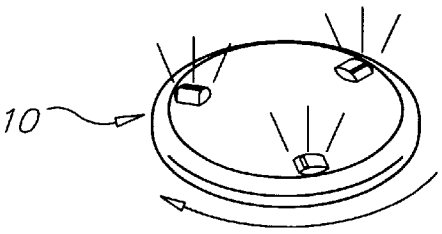
FIG. 9 is a perspective view of the amusement device of FIG. 1 in use.
Figure 9:
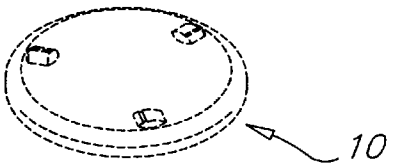
Figure 9:
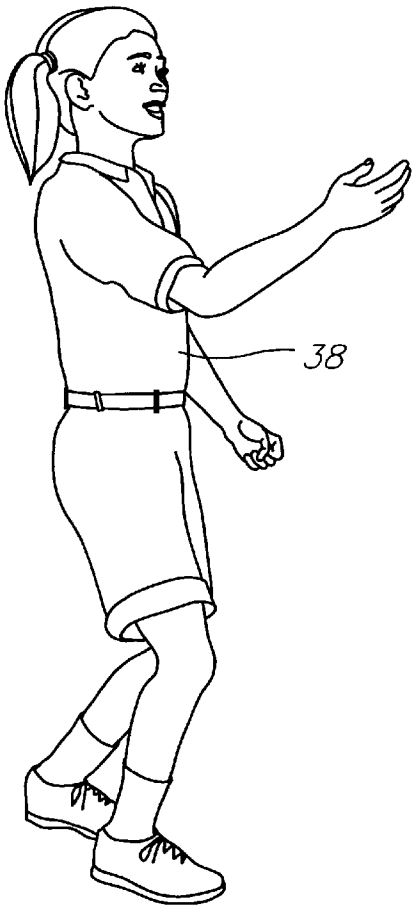

Each whistle 22 is aerodynamically shaped having a leading edge 32 and trailing edge 34 between edges 32 and 34 and a wing-shaped top portion 36 which extends above the top surface 18 of the device 10. The aperture 30 of each whistle 22 is positioned so that airflow across the aperture 30 will be divided by the edges of the aperture, depending upon the direction of spin. As shown in FIG. 9, the direction of spin of the device 10 thrown by the user 38 should be clockwise, so air will enter aperture 30, which is adjacent leading edge 32, enabling a portion of the airflow to enter the closed chamber 26. The closed chamber 29 then acts as a resonant chamber creating a vibratory motion-causing whistle 22 to function as a tubular resonator to produce a sound.

Figure 4:
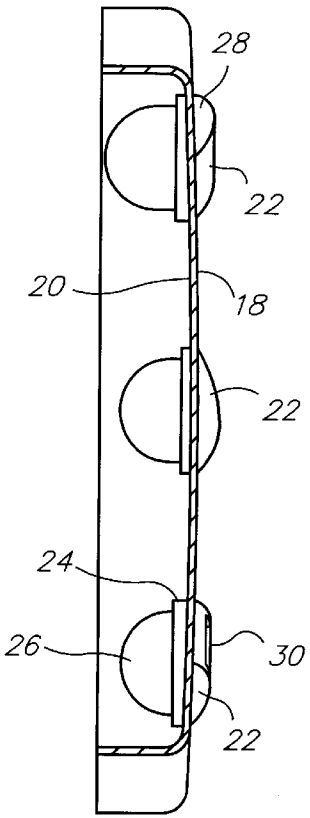
FIG. 4 is a cross-sectional view taken substantially along the plane indicated by line 4—4 of FIG. 1.
Figure 2:
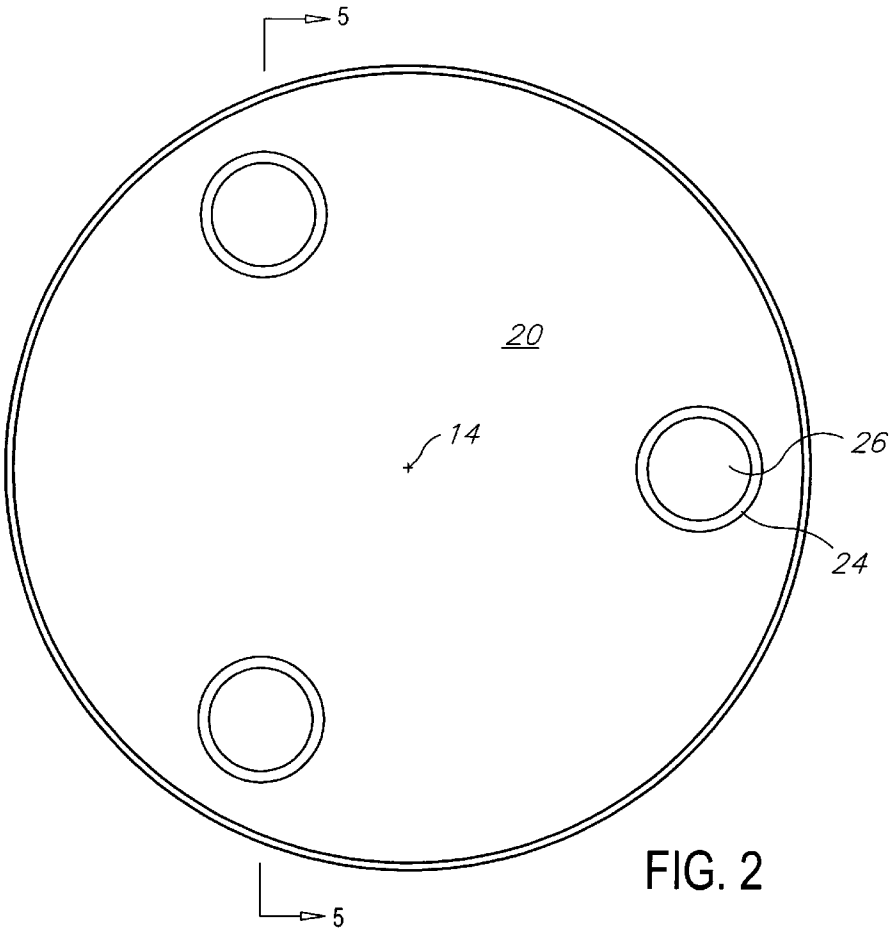
FIG. 2 is a bottom plan view of the amusement device of FIG. 1.
Figure 5:
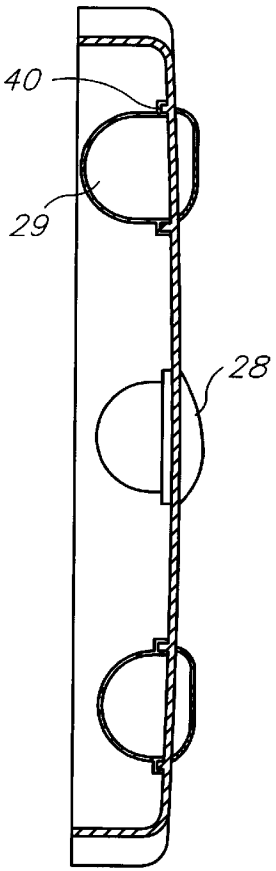
FIG. 5 is a cross-sectional view taken substantially along the plane indicated by line 5—5 of FIG. 2.
Figure 3:
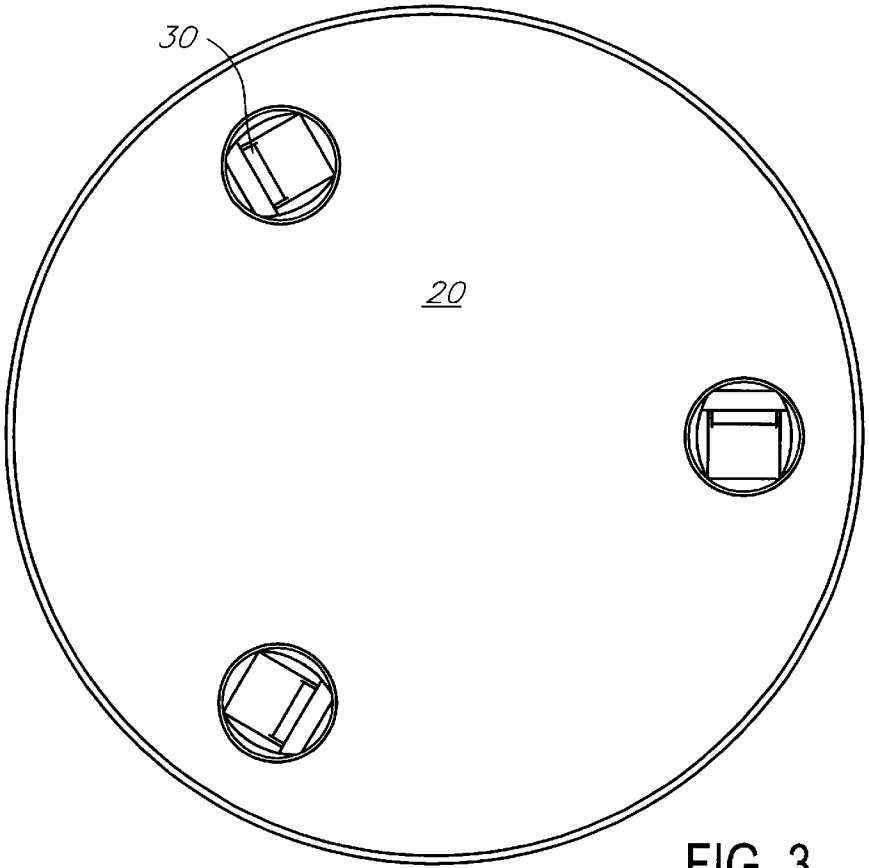
FIG. 3 is view similar to FIG. 2 with the caps removed to illustrate the interior of the sound-emitting portions of the amusement device.

Whistles 22 may also be formed of plastic, metal or the like and the hemispherical portions 26 may be constructed separately and later mounted on the device 10 by snapping the tubular portion 24 onto a downwardly extending flange 40 (see FIG. 5) depending from lower surface 20 of disk 10. The top portions 28 of whistles 22 may also be molded integral with the central portion of disk 10. Because of the aerodynamic or wing-shape in cross-section of each whistle top portion 28, airflow over the whistle is laminar, rather than turbulent, creating a clean air flow and low pressure at the entrance 30 to the air chamber 29 of each whistle, pulling air which has entered into the resonant chamber 29 out, providing a substantially continuous whistling noise. The whistle bottom portions can be of different sizes to effect different noises, as shown in FIGS. 4 and 5 by snapping different size bottom portions 26 or caps onto flange 40.

Figure 7:
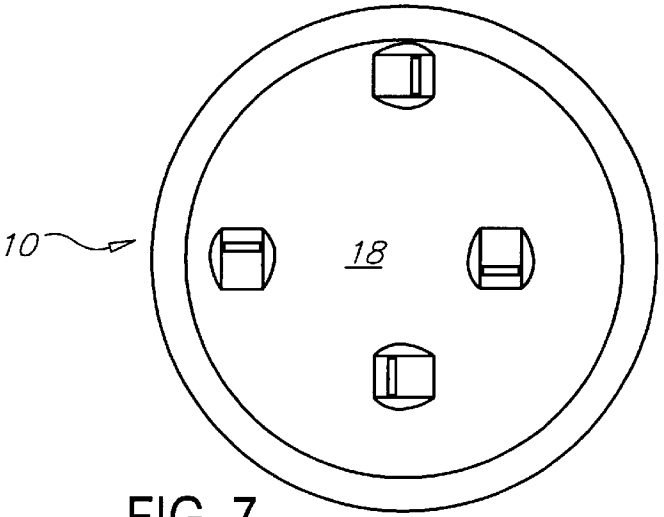
FIG. 7 is a top plan view of yet another embodiment of the amusement device.
Figure 8:
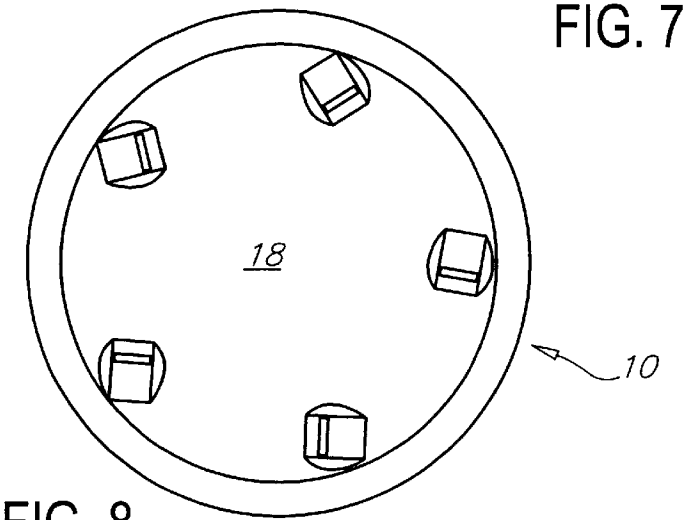
FIG. 8 is a top plan view of still another embodiment of the amusement device.

The bottom of each whistle 22 may also be snapped in place to the molded top or aerodynamic wing portion 28, which may be located at different radii, as shown in FIG. 7, or with its with its entrance 30 not tangent to the direction of air flow, as in FIG. 8.This will result in different amounts of air to enter and be pulled from the whistle chamber 29 to emit different sounds or tones. This permits the whistle to be replaceable and/or pre-selectable as to its noise-emitting sound.

Figure 6:
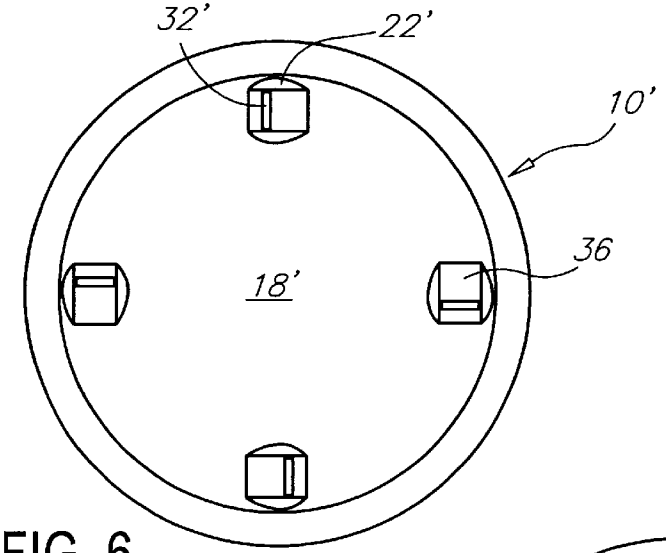
FIG. 6 is a top plan view of an alternative embodiment of the amusement device of the present invention with sound-emitting devices facing in both directions so the device can be thrown counterclockwise or clockwise to produce sound.

As shown in the embodiment of FIG. 6, four whistles 22' can be provided on surface 18' of disk 10' with every other entrance aperture 32' facing in an opposite direction. This enables disk 10' to be thrown in both a clockwise and counter-clockwise direction to cause every other whistle 22' to emit sound depending on the thrown direction and with the forehand or backhand.

Furthermore, the disk body consisting of the central section and the outer rim could be comprised of multiple different elements or parts and colors attached together.

The whistle components, the resonance chambers or the whistle devices could be integral with the disk body located at the central section or the outer rim.

Additionally, the resonance chambers and the whistle devices could be replaceable and rotatable on their axes, clockwise or counter-clockwise and located at the central section or the outer rim. By being able to rotate the whistle devices, the disk can operate by being thrown in either a clockwise or counter-clockwise direction.

We claim:

1. A saucer-shaped flying toy amusement device to be sailed through the air and rotated about an axis of rotation, comprising:

a circular central disk having an upper surface and a lower surface and a depending rim positioned concentrically about the circular central disk and having an outer surface;

a curved transition portion positioned between the circular central disk and the rim, said transition portion having a slightly convex upper surface which provides a smooth transition between the upper surface of the circular central disk and the outer surface of the rim;

a plurality of pneumatically-operated whistle devices projecting above said convex upper surface and symmetrically spaced about the axis of rotation of said circular central disk and each whistle device having a whistle chamber comprising a substantially hemispherical hollow body extending below a lower portion of said circular central disk and having an aerodynamically wing-shaped upper portion with an elongated slot forming an aperture located above the upper surface of said circular central disk adjacent the leading edge of said upper portion facing in a direction of rotation of said circular central disk, said hollow body extending outwardly from the toy into the air, said aperture being aligned so that, when the toy is rotated the whistle device is intermittently operated.

2. The toy amusement device of claim 1 wherein said plurality of whistle devices include at least two whistle devices generating sounds of different tones.

3. The toy amusement device of claim 2 wherein said at least two whistle devices have different size hemispherical hollow bodies extending below the lower portion of said central disk.

4. The toy amusement device of claim 2 wherein said elongated slot aperture formed in the upper portion of each of said at least two whistle devices face opposite directions on said circular central disk surface.

5. The toy amusement device of claim 3 wherein said elongated slot aperture formed in the upper portion of each of said at least two whistle devices face opposite directions on said circular central disk surface.

6. The toy amusement device of claim 1 wherein said whistle devices are mounted on the upper surface of said circular central disk tangent to its circular periphery.

7. The toy amusement device of claim 6 wherein said plurality of whistle devices include at least two whistle devices generating sounds of different tones.

8. The toy amusement device of claim 7 wherein said at least two whistles have different size hemispherical hollow bodies extending below the lower portion of said circular central disk.

9. The toy amusement device of claim 8 wherein said elongated slot aperture formed in the upper portion of each of said at least two whistle devices face opposite directions on said circular central disk surface.

10. The toy amusement device of claim 3 wherein said hollow lower hemispherical bodies are replaceable.

11. The toy amusement device of claim 10 wherein said hollow hemispherical bodies are replaceable by mating a flange adjacent the top of said hollow hemispherical body with a flange extending downwardly from the lower surface of said central disk beneath each of said aerodynamically wing-shaped upper portion.

12. The toy amusement device of claim 1 wherein said whistle devices are molded integral with said circular central disk.

13. The toy amusement device of claim 1 wherein said whistle devices are mounted on said circular central disk at different radii from the axis of rotation of said disk.

14. The toy amusement device of claim 1 wherein all of said whistle devices have elongated slot apertures facing perpendicular to a tangent line on said circular central disk.

15. The toy amusement device of claim 1 wherein at least some of said whistle devices have elongated slot apertures at an angle to a tangent line on said circular central disk to vary the tones emitted by said whistles.

* * * * *